US007373997B2

(12) United States Patent
Kembaiyan et al.

(10) Patent No.: US 7,373,997 B2
(45) Date of Patent: May 20, 2008

(54) LAYERED HARDFACING, DURABLE HARDFACING FOR DRILL BITS

(75) Inventors: Kumar T. Kembaiyan, Houston, TX (US); Madapusi K. Keshavan, The Woodlands, TX (US); Alysia C. White, Houston, TX (US); Brian A. White, Houston, TX (US)

(73) Assignee: Smith International, Inc., Houston, TX (US)

( * ) Notice: Subject to any disclaimer, the term of this patent is extended or adjusted under 35 U.S.C. 154(b) by 265 days.

(21) Appl. No.: 11/061,305

(22) Filed: Feb. 18, 2005

(65) Prior Publication Data

US 2006/0185908 A1 Aug. 24, 2006

(51) Int. Cl.
*E21B 10/46* (2006.01)
*C23C 30/00* (2006.01)

(52) U.S. Cl. ..... 175/374; 175/375

(58) Field of Classification Search ..... 175/374, 175/375, 425, 435

See application file for complete search history.

(56) References Cited

U.S. PATENT DOCUMENTS

| | | | |
|---|---|---|---|
| 2,906,612 | A | 9/1959 | Anthony et al. |
| 3,334,975 | A | 8/1967 | Quaas et al. |
| 4,156,329 | A | 5/1979 | Daniels et al. |
| 4,521,664 | A | 6/1985 | Miller |
| 4,556,607 | A | 12/1985 | Sastri |
| 4,610,320 | A | 9/1986 | Beakley |
| 4,726,432 | A | 2/1988 | Scott et al. |
| 4,734,339 | A | 3/1988 | Schachner et al. |
| 4,776,863 | A | 10/1988 | van den Berg et al. |
| 4,836,307 | A | 6/1989 | Keshavan et al. |
| 4,842,937 | A | 6/1989 | Meyer et al. |
| 4,884,477 | A | 12/1989 | Smith et al. |
| 4,984,940 | A | 1/1991 | Bryant et al. |
| 5,135,061 | A | 8/1992 | Newton, Jr. |
| 5,145,739 | A | 9/1992 | Sarin |
| 5,161,335 | A | 11/1992 | Tank |
| 5,236,116 | A | 8/1993 | Solanki et al. |
| 5,352,269 | A | 10/1994 | McCandlish et al. |
| 5,445,231 | A | 8/1995 | Scott et al. |
| 5,492,186 | A | 2/1996 | Overstreet et al. |
| 5,518,766 | A | 5/1996 | Bigelow et al. |
| 5,535,838 | A | 7/1996 | Keshavan et al. |
| 5,605,198 | A | 2/1997 | Tibbitts et al. |
| 5,679,445 | A | 10/1997 | Massa et al. |
| 5,755,299 | A | 5/1998 | Langford, Jr. et al. |
| 5,791,422 | A | 8/1998 | Liang et al. |
| 5,791,423 | A | 8/1998 | Overstreet et al. |
| 5,921,330 | A | 7/1999 | Sue et al. |

(Continued)

FOREIGN PATENT DOCUMENTS

| | | |
|---|---|---|
| EP | 0 857 552 B1 | 8/1998 |

*Primary Examiner*—Giovanna C Wright
(74) *Attorney, Agent, or Firm*—Osha Liang LLP

(57) ABSTRACT

A drill bit having a bit body having at least one blade thereon, at least one cutter pocket disposed on the at least one blade, at least one cutter disposed in the at least one cutter pocket, hardfacing applied to at least a selected portion of the drill bit is shown and described. The hardfacing includes a first hardfacing layer disposed on the selected portion of the drill bit, a second hardfacing layer disposed on the first hardfacing layer, wherein the first hardfacing layer has a hardness different than a hardness of the second hardfacing layer.

17 Claims, 3 Drawing Sheets

U.S. PATENT DOCUMENTS

| | | | | |
|---|---|---|---|---|
| 6,039,131 | A | 3/2000 | Beaton | |
| 6,360,832 | B1 | 3/2002 | Overstreet et al. | |
| 6,439,327 | B1 * | 8/2002 | Griffin et al. | 175/434 |
| 6,533,831 | B2 | 3/2003 | Zimmer | |
| 6,601,475 | B2 | 8/2003 | Davies et al. | |
| 6,615,936 | B1 * | 9/2003 | Mourik et al. | 175/426 |
| 6,651,756 | B1 | 11/2003 | Costo, Jr. et al. | |
| 6,659,206 | B2 | 12/2003 | Liang et al. | |
| 6,695,080 | B2 * | 2/2004 | Presley et al. | 175/391 |
| 6,772,849 | B2 | 8/2004 | Oldham et al. | |
| 2001/0003884 | A1 | 6/2001 | Wei et al. | |
| 2001/0008190 | A1 | 7/2001 | Scott et al. | |
| 2003/0079565 | A1 | 5/2003 | Liang et al. | |

* cited by examiner

LAYERED HARDFACING, DURABLE HARDFACING FOR DRILL BITS

BACKGROUND OF INVENTION

1. Field of the Invention

The invention relates generally to hardfacing which provide improved durability. In particular, the present invention relates to hardfacing for use on steel body drill bits.

2. Background Art

Polycrystalline diamond compact ("PDC") cutters are known in the art for use in earth-boring drill bits. Typically, bits using PDC cutters include an integral bit body which may be made of steel or fabricated from a hard matrix material such as tungsten carbide (WC). A plurality of PDC cutters is mounted along the exterior face of the bit body in extensions of the bit body called "blades." Each PDC cutter has a portion which typically is brazed in a recess or pocket formed in the blade on the exterior face of the bit body.

The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

While steel body bits may have toughness and ductility properties which make them resistant to cracking and failure due to impact forces generated during drilling, steel is more susceptible to erosive wear or abrasive caused by contact with the formation and by high-velocity drilling fluids and formation fluids which carry abrasive particles, such as sand, rock cuttings, and the like. Generally, steel body PDC bits are coated with a more erosion-resistant material, such as tungsten carbide, to improve their erosion resistance. However, tungsten carbide and other erosion-resistant materials are relatively brittle. During use, a thin coating of the erosion-resistant material may crack, peel off or wear, exposing the softer steel body which is then rapidly eroded. This can lead to loss of PDC cutters as the area around the cutter is eroded away, causing the bit to fail.

Typically, a hardfacing material is applied, such as by arc or gas welding, to the exterior surface of the drill bit to protect the bit against erosion and abrasion. The hardfacing material typically includes one or more metal carbides, which are bonded to the steel body by a metal alloy ("binder alloy"). In effect, the carbide particles are suspended in a matrix of metal forming a layer on the surface of the teeth. The carbide particles give the hardfacing material hardness and wear resistance, while the matrix metal provides fracture toughness to the hardfacing.

Many factors affect the durability of a hardfacing composition in a particular application. These factors include the chemical composition and physical structure (size, shape, and particle size distribution) of the carbides, the chemical composition and microstructure of the matrix metal or alloy, and the relative proportions of the carbide materials to one another and to the matrix metal or alloy. The metal carbide most commonly used in hardfacing is tungsten carbide. Small amounts of tantalum carbide and titanium carbide may also be present in such material, although these other carbides may be considered to be deleterious.

Many different types of tungsten carbides are known based on their different chemical compositions and physical structure. Four types of tungsten carbide commonly used in hardfacing drill bits are cast tungsten carbide, carburized tungsten carbide, macro-crystalline tungsten carbide, and cemented tungsten carbide (also known as sintered tungsten carbide).

Tungsten forms two carbides, WC and $W_2C$, and there can be an essentially continuous range of compositions therebetween. Cast carbide refers to a eutectic mixture of the WC and $W_2C$ compounds, and as such is substoichiometric; that is, it has less carbon than the WC form. Cast carbide is solidified from the molten state and comminuted to the desired particle size.

Cemented tungsten carbide refers to a material formed by mixing particles of tungsten carbide, typically monotungsten carbide, and particles of cobalt or other iron group metal, and sintering the mixture. In a typical process for making cemented tungsten carbide, small tungsten carbide particles, e.g., 1-15 microns, and cobalt particles are vigorously mixed with a small amount of organic wax which serves as a temporary binder. An organic solvent may be used to promote uniform mixing. The mixture may be prepared for sintering by either of two techniques: it may be pressed into solid bodies often referred to as green compacts; alternatively, it may be formed into granules or particles such as by pressing through a screen, or tumbling and then screened to obtain more or less uniform particle size.

Such green compacts or particles are then heated in a vacuum furnace to first evaporate the wax and then to a temperature near the melting point of cobalt (or the like) to cause the tungsten carbide particles to be bonded together by the metallic phase. After sintering, the compacts are crushed and screened for the desired particle size. Similarly, the sintered particles, which tend to bond together during sintering, are gently churned in a ball mill with media to separate them without damaging the particles. Some particles may be crushed to break them apart. These are also screened to obtain a desired particle size. The crushed cemented carbide is generally more angular than the particles which tend to be rounded.

Another type of tungsten carbide is macro-crystalline carbide. This material is essentially stoichiometric tungsten carbide created by a thermite process. Most of the macro-crystalline tungsten carbide is in the form of single crystals, but some bicrystals of tungsten carbide may also form in larger particles. Single crystal stoichiometric tungsten carbide is commercially available from Kennametal, Inc., Fallon, Nev.

Carburized carbide is yet another type of tungsten carbide. Carburized tungsten carbide is a product of the solid-state diffusion of carbon into tungsten metal at high temperatures in a protective atmosphere. Sometimes, it is referred to as fully carburized tungsten carbide. Such carburized tungsten carbide grains usually are multi-crystalline, i.e., they are composed of tungsten carbide agglomerates. The agglomerates form grains that are larger than the individual tungsten carbide crystals. These large grains make it possible for a metal infiltrant or an infiltration binder to infiltrate a powder of such large grains. On the other hand, fine grain powders, e.g., grains less than 5 μm, do not infiltrate satisfactorily. Typical carburized tungsten carbide contains a minimum of 99.8% by weight of tungsten carbide, with a total carbon content in the range of about 6.08% to about 6.18% by weight.

Regardless of the type of hardfacing material used, designers continue to seek improved properties (such as improved wear resistance, thermal resistance, etc.) in the hardfacing materials. Unfortunately, increasing wear resistance usually results in a loss in fracture toughness, or vice-versa.

Typically, a drill bit is hardfaced with a single hardfacing. To achieve higher wear resistance (mainly against abrasion or erosion), the hardfacing composition may be designed to have a maximum amount of carbide content in the metallic matrix or the thickness of the hardfacing layer may be increased. However, a hardfacing with higher hardness and higher carbide content is more prone to cracking and delamination, especially as the thickness of the hardfacing increases. Furthermore, the tenacity or fracture toughness of a hardfacing layer decreases with an increased thickness of the single hardfacing layer, limiting the life of the hardfacing.

Accordingly, there exists a need for a hardfacing having increased toughness, hardness, and thickness without increased tendency for cracking or delamination in the hardfacing.

SUMMARY OF INVENTION

In one aspect, the present invention relates to a drill bit that includes a steel bit body having at least one blade thereon, at least one cutter pocket disposed on the at least one blade, at least one cutter disposed in the at least one cutter pocket, and hardfacing applied to at least a selected portion of the drill bit, where the hardfacing includes a first hardfacing layer disposed on the selected portion of the drill bit; and a second hardfacing layer disposed on the first hardfacing layer, and where the first hardfacing layer and the second hardfacing layer differ with respect to at least one property.

In another aspect, the present invention relates to a method of applying hardfacing that includes the steps of applying a first hardfacing layer to at least a selected portion of a drill bit and applying a second hardfacing layer on the first hardfacing layer, where the applying the first hardfacing layer differs from applying the second hardfacing layer, such that the first hardfacing layer and the second hardfacing layer differ with respect to at least one property.

In another aspect, the present invention relates to a hardfacing that includes a first hardfacing layer and a second hardfacing layer disposed next to the first hardfacing layer, where the first hardfacing layer and the second hardfacing layer differ with respect to at least one property.

In another aspect, the method of applying a first hardfacing layer differs from the applying a second hardfacing layer such that the first hardfacing layer contains less carbide for a given volume than the second hardfacing layer.

In another aspect, the first hardfacing layer has a matrix metallic binder having a chemical composition different from a chemical composition of a matrix metallic binder of the second hardfacing layer for a given carbide content such that the first hardfacing layer has a hardness less than the second hardfacing layer.

In yet another aspect, the first hardfacing layer includes tungsten carbide having a shape, size, and particle size distribution different from a shape, size, and particle size distribution of tungsten carbide of the second hardfacing layer such that the first hardfacing layer has a hardness less than the second hardfacing layer.

In yet another aspect, the first hardfacing layer has a tungsten carbide composition different from a tungsten carbide composition of the second hardfacing layer such that the first hardfacing layer has a toughness greater than the second hardfacing layer.

Other aspects and advantages of the invention will be apparent from the following description and the appended claims.

DETAILED DESCRIPTION

In one aspect, embodiments of the invention relate to a layered hardfacing. In particular, embodiments of the invention relate to a multiple layered hardfacing on a drill bit (such as a steel body bit) and methods for applying a multiple layered hardfacing.

Figure 1:
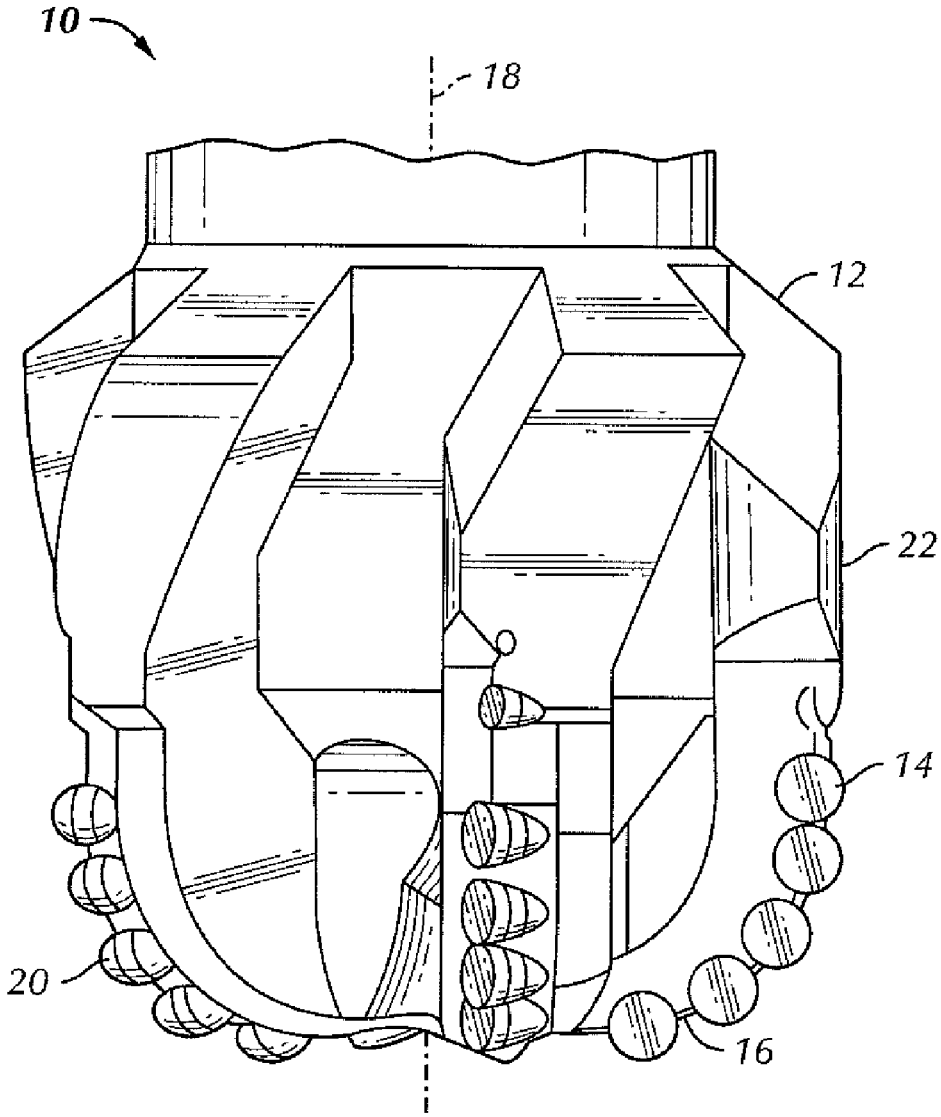
FIG. 1 is an illustration of a steel body drill bit.

Referring to FIG. 1, a drill bit in accordance with an embodiment of the invention is shown. In this embodiment, as shown in FIG. 1, a drill bit 10 includes a steel bit body 12, which includes at least one PDC cutter 14. The steel bit body 12 is formed with at least one blade 16, which extends generally outwardly away from a central longitudinal axis 18 of the drill bit 10. In the present embodiment, the steel bit body includes multiple layers of hardfacing (not shown separately). The PDC cutter 14 is disposed on the blade 16. The blade 16 includes at least one cutter pocket 20 which is adapted to receive the PDC cutter 14, and the PDC cutter 14 is usually brazed into the cutter pocket 20. The area of the blade 16 that contacts the wall of the hole (not shown separately) is the gage area 22. The number of blades 16 and/or PDC cutters 14 is related, among other factors, to the type of formation to be drilled, and can thus be varied to meet particular drilling requirements. The PDC cutter 14 may be formed from a sintered tungsten carbide composite substrate (not shown separately) and a polycrystalline diamond compact (not shown separately), among other materials. The polycrystalline diamond compact and the sintered tungsten carbide substrate may be bonded together using any method known in the art.

Figure 2:
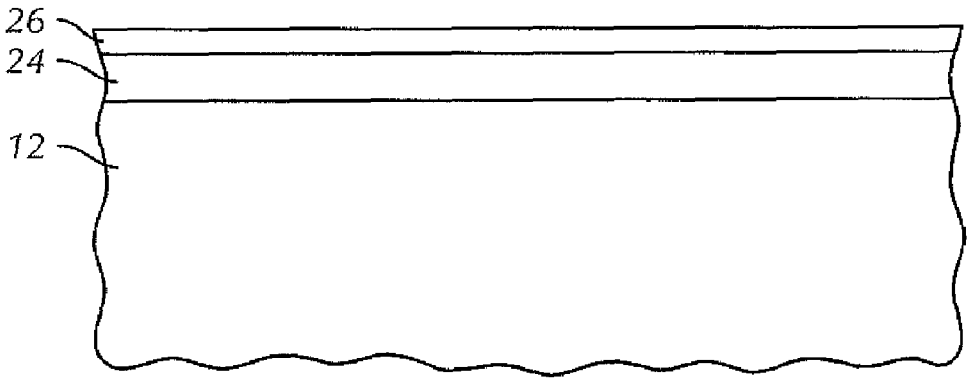
FIG. 2 is an illustration of hardfacing according to one embodiment of the present invention.

Referring to FIG. 2, a steel bit body in accordance with an embodiment of the present invention is shown. In this embodiment, as shown in FIG. 2, a portion of the steel body bit 12 is coated with a first hardfacing layer 24. The first hardfacing layer 24 is coated with a second hardfacing layer 26. According to one embodiment of the present invention, the first hardfacing layer 24 differs from the second hardfacing layer 26 with respect to at least one property. The at least one property may include hardness, thickness, carbide content, toughness, composition, binder content, density, porosity, elastic modulus, microstructure, abrasion resistance, or erosion resistance. In one embodiment, the first hardfacing layer 24 has a hardness less than the second hardfacing layer 24. Alternatively, the first hardfacing layer 24 has a hardness greater than the hardness of the second hardfacing layer 26.

Figure 3:
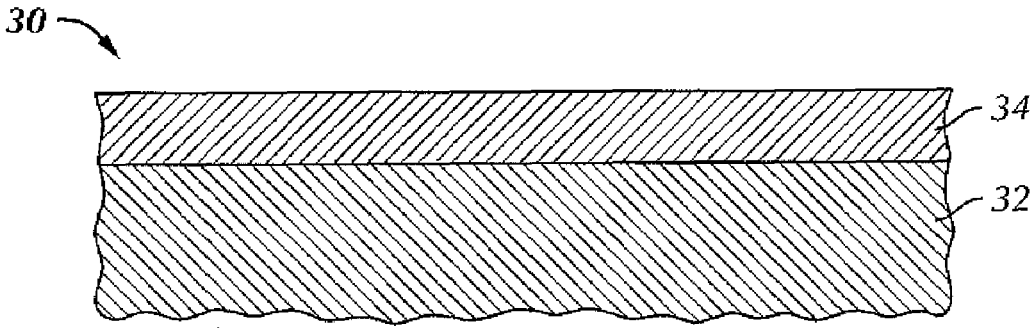
FIG. 3 is an illustration of hardfacing according to one embodiment of the present invention.

Referring to FIG. 3, a hardfacing in accordance with an embodiment of the present invention is shown. In this embodiment, as shown in FIG. 3, a hardfacing 30 includes a first hardfacing layer 32 and a second hardfacing layer 34 disposed next to the first hardfacing layer 32. The first hardfacing layer 32 differs from the second hardfacing layer with respect to at least one property. According to one embodiment of the present invention, the first hardfacing layer 32 may be located on a selected portion of a drill bit assembly and the second hardfacing layer 34 may be disposed on the first hardfacing layer 32. According to another embodiment of the present invention, the second hardfacing layer 34 may be located on the selected portion of the drill bit assembly and the first hardfacing layer 32 may be disposed on the second hardfacing layer 34.

The at least property by which the first hardfacing layer and second hardfacing layer may differ include various chemical, material, and mechanical properties such as hardness, thickness, carbide content, toughness, composition, binder content, density, porosity, elastic modulus, microstructure, abrasion resistance, and erosion resistance. In one embodiment, the first hardfacing layer 32 may have a carbide content less than the carbide content of the second hardfacing layer 34. In another embodiment, the first hardfacing layer 32 may have a hardness less than the hardness of the second hardfacing layer 34. In another embodiment, the first hardfacing layer 32 has a density different than a density of the second hardfacing layer. In yet another embodiment, the first hardfacing layer 32 has a porosity different than a porosity of the second hardfacing layer 34. The variations in carbide content, hardness, density and porosity between the two layers may be accomplished through compositional adjustments or different application techniques of the hardfacing. In one embodiment, the hardfacing 30 may be located on a selection portion of a drill bit assembly (not shown separately).

According to one embodiment, the first hardfacing layer 32 may have a toughness different than the toughness of the second hardfacing layer 34. In another embodiment, the composition of the first hardfacing layer 32 may differ from the composition of the second hardfacing layer 34. In yet another embodiment the first hardfacing layer 32 may have a binder content different than the binder content of the second hardfacing layer 34. In another embodiment, the first hardfacing layer 32 has an elastic modulus different than the elastic modulus of the second hardfacing layer 34.

According to one embodiment, the first hardfacing layer 32 has a microstructure different from the microstructure of the second hardfacing layer 34. In another embodiment, the abrasion resistance of the first hardfacing layer 32 is different from the abrasion resistance of the second hardfacing layer 34. In yet another embodiment, the first hardfacing layer 32 has an erosion resistance different that the erosion resistance of the second hardfacing layer 34.

It is within the scope of the present invention that the first hardfacing layer may differ from the second hardfacing with respect to only one property or more than one type of property. For example, the first hardfacing layer may have a different microstructure, abrasion and erosion resistance while having the same hardness as the second hardfacing layer. In another example, the first hardfacing layer may have a hardness less than the second hardfacing layer and a toughness greater than the second hardfacing layer.

Hardfacing layers may be comprised of wear-resistant particles dispersed in a metal or alloy matrix. In a hardfacing layer, the wear-resistant particles give the hardfacing layer hardness and wear resistance. According to one embodiment of the present invention, the first hardfacing layer and second hardfacing layer include tungsten carbide as the wear resistant particles. In other embodiments, the first hardfacing layer includes tungsten carbide having a shape, size, and particle size distribution different from a shape, size, and particle size distribution of tungsten carbide of the second hardfacing layer such that the first hardfacing layer has a hardness less than the second hardfacing layer. Alternatively, the first hardfacing layer includes tungsten carbide having a shape, size, and particle size distribution different from a shape, size, and particle size distribution of tungsten carbide of the second hardfacing layer such that the first hardfacing layer has a hardness greater than the second hardfacing layer.

Various hardfacing compositions are disclosed in U.S. Pat. No. 4,836,307 issued to Keshavan, et al., U.S. Pat. No. 5,791,422 issued to Liang, et al., U.S. Pat. No. 5,921,330 issued to Sue, et al., and U.S. Pat. No. 6,659,206 issued to Liang et al. These references are herein incorporated by reference in their entirety.

In some embodiments of the present invention, the tungsten carbide may be cast tungsten carbide. The cast tungsten carbide may be crushed or pellets, preferably pellets. In one embodiment, the first hardfacing layer and the second hardfacing layer include spherical cast tungsten carbide. In another embodiment the first hardfacing layer and the second hardfacing layer include a mixture of spherical cast tungsten carbide and crushed cast tungsten carbide. In yet other embodiments, the hardfacing layers may include other forms of tungsten carbide (e.g., carburized tungsten carbide, macro-crystalline tungsten carbide, and cemented tungsten carbide).

According to one embodiment of the present invention, the first and second hardfacing layers may include tungsten carbide. In some embodiments, the carbide content of the first hardfacing layer may be less than the carbide content of the second hardfacing layer. In some embodiments, the first hardfacing layer has a carbide content in a range of about 25 to 50% by weight while, the second hardfacing layer has a carbide content in a range of about 40 to 70% by weight. In a preferred embodiment, the first hardfacing layer, for example, may have a carbide content of about 40% by weight and the second hardfacing layer may have a carbide content of about 50% by weight. In another preferred embodiment, the first hardfacing layer, for example, may have a carbide content of about 40% by weight and the second hardfacing layer may have a carbide content of about 60% by weight. Alternatively, the carbide content of the first hardfacing layer may be greater than the carbide content of the second hardfacing layer.

The first hardfacing layer and the second hardfacing layer also include a matrix metal or alloy as the residual content of the layers. In one embodiment the first hardfacing layer has a binder content differing from the binder content of the second hardfacing layer. In another embodiment, the first hardfacing layer and the second hardfacing layer may include Co, Ni, Fe, or alloy or mixtures thereof. The matrix metal (or alloy) provides fracture toughness to the hardfacing layer. In addition, the matrix metal also promotes the bonding between the hardfacing layer and the metal object on which it is deposited. In one embodiment, the first hardfacing layer has a matrix metallic binder having a chemical composition different than a chemical composition of a matrix metallic binder of the second hardfacing layer for a given carbide content such that the first hardfacing layer has a hardness less than the second hardfacing layer.

In some embodiments of the invention, the first hardfacing layer may have a microstructure different from the microstructure of the second hardfacing layer. The microstructures of the hardfacing layers may be characterized by the wear-resistant particles dispersed in the metal or alloy matrix. Different microstructures may result in different abrasion, erosion and delamination resistance for the hardfacing.

In some embodiments of the invention, the first hardfacing layer may have a thickness different from a thickness of the second hardfacing layer. In some embodiments, the thickness of the first hardfacing layer, for example, may be twice the thickness of the second hardfacing layer. In other embodiments, the first hardfacing layer may be three times the thickness of the second hardfacing layer. In yet other embodiments, the second hardfacing layer may be thicker than the first hardfacing layer. Alternatively, the thickness of the first hardfacing layer may be less than the thickness of the second hardfacing layer.

The first hardfacing layer may be deposited on a select portion of the drill bit. In some embodiments, the first hardfacing layer may be deposited on at least a portion of at least one blade of the drill bit. In other embodiments, the first hardfacing layer may be deposited on the gage area of the drill bit. It is within the scope of this invention that a selected area of the drill bit may be deposited with a first hardfacing layer having a different composition than a first hardfacing layer deposited on another selected area of the drill bit. The hardfacing composition of the first hardfacing layer and the composition of the second hardfacing layer may be selected according to the location of the drill bit desired to be hardfaced.

Furthermore, the toughness of the first hardfacing layer and the second hardfacing layer may be selected according to the location of the drill bit desired to be hardfaced, and in particular to a property of the surface of the location desired to be hardfaced. In one embodiment, the surface may be geometrically intricate (with sharp corners and sharp radii), in which case, the first hardfacing layer may have a higher toughness than a first hardfacing layer at a location that is not intricate. According to one embodiment of the present invention, the first hardfacing layer has a tungsten carbide composition different from a tungsten carbide composition of the second hardfacing layer such that the first hardfacing layer has a toughness greater than the second hardfacing layer. The differing compositions of tungsten carbide may include relative amounts of cemented tungsten carbide, cast tungsten carbide, macrocrystalline tungsten carbide, and agglomerated tungsten carbide.

The hardness of the first hardfacing layer and second hardfacing layer may be dependent upon various factors. These factors may include the specific type and composition of tungsten carbide, particle shape, size, and distribution of the wear-resistant material, the composition of the matrix metal, the rate of cooling in the formation of cast tungsten carbide, and the techniques used in applying the hardfacing layers.

Figure 4:
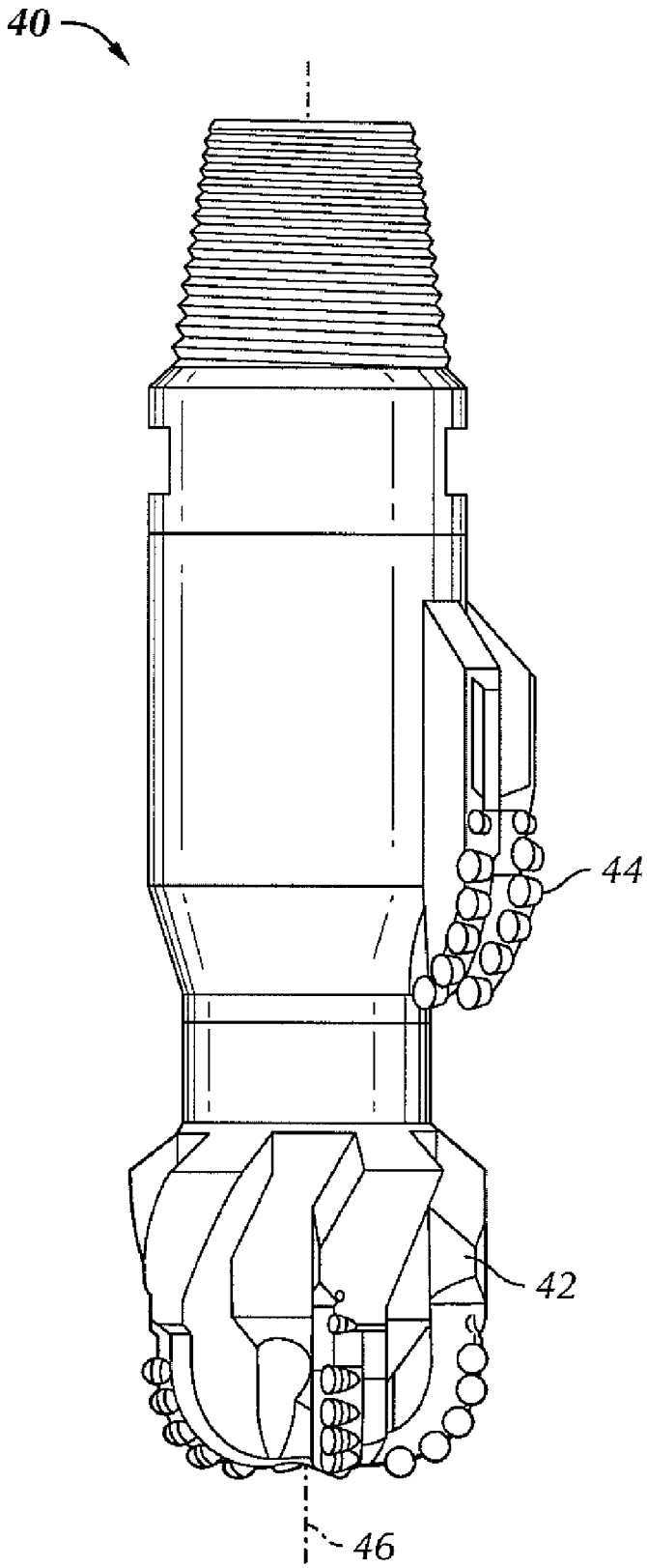
FIG. 4 is an illustration of a bi-center drill bit.

A first hardfacing layer and second hardfacing layer may also be deposited on selection portions of a bottom hole assembly (BHA). The BHA may include a drill bit (e.g., steel body bit, bi-center bit) and other downhole tools (e.g., stabilizer, hole opener and reamer). One example of a bi-center bit may be found in U.S. Pat. No. 6,039,131, which is herein incorporated by reference in its entirety. Referring to FIG. 4, a bi-center bit is shown. A conventional bi-center bit 40 comprises a lower pilot bit section 42 and a longitudinally offset, radially extending reaming section 44. During drilling, the bit rotates about the axis 46 of the pilot section, causing the reaming section 44 to cut a hole having a diameter equal to twice the greatest radius of the reaming section 44. The first hardfacing layer may be deposited on a selected portion of the bi-center bit and the second hardfacing layer on the first hardfacing layer.

Furthermore, the multiple layer hardfacing of the present invention may be applied to selected portions of a blade stabilizer. Traditional stabilizers are located in the drilling assembly behind the drill bit for controlling the trajectory of the drill bit as drilling progresses. In a conventional rotary drilling assembly, a drill bit may be mounted onto a lower stabilizer, which is disposed approximately 5 feet above the bit. Typically the lower stabilizer is a fixed blade stabilizer that includes a plurality of concentric blades extending radially outwardly and spaced azimuthally around the circumference of the stabilizer housing. A plurality of drill collars extends between the lower stabilizer and other stabilizers in the drilling assembly. An upper stabilizer is typically positioned in the drill string approximately 30-60 feet above the lower stabilizer. There could also be additional stabilizers above the upper stabilizer. The upper stabilizer may be either a fixed blade stabilizer or an adjustable blade stabilizer that allows the blades to be collapsed into the housing as the drilling assembly passes through the casing and then expanded in the borehole below. The first hardfacing layer may be applied on a selected portion of the lower stabilizer blades, the upper stabilizer blades, and/or the additional stabilizer blades.

Figure 5:
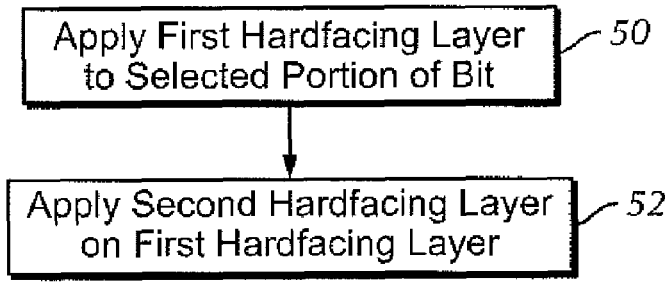
FIG. 5 is a flowchart according to one embodiment of the present invention.

According to one embodiment of the present invention, the multiple layered hardfacing may be applied as described in FIG. 5. As shown in FIG. 5, a first hardfacing layer is applied to a selected portion of a drill bit (step 50). A second hardfacing layer is applied on the first hardfacing layer (step 52). The application of the second hardfacing layer may use a different technique or a different material such that the second hardfacing layer has a hardness greater than the second hardfacing layer. In another embodiment, the method of applying a first hardfacing layer differs from the method of applying a second hardfacing layer such that the first hardfacing layer contains less carbide for a given volume than the second hardfacing layer.

In accordance with embodiments of the present invention, the application of the first hardfacing layer may use a technique that is the same or different from the technique used in the application of the second hardfacing layer. The techniques that may be used include various welding and thermal spray coating techniques. Among the welding techniques that may be used are an oxyacetylene welding process (OXY), plasma transferred arc (PTA), an atomic hydrogen welding (ATW), welding via tungsten inert gas (TIG), gas tungsten arc welding (GTAW) or other applicable processes as known by one of ordinary skill in the art. Among the thermal spray process that may be used are high velocity oxy-fuel spraying (HVOF), high velocity air fuel spraying (HVAF), flame spray, or other applicable process as known by one of ordinary skill in the art.

In oxyacetylene welding, for example, the hardfacing material is typically supplied in the form of a tube or hollow rod ("a welding tube"), which is filled with granular material of a selected composition. The tube is usually made of steel (iron) or similar metal (e.g., nickel and cobalt) which can act as a binder when the rod and its granular contents are heated. The tube thickness is selected so that its metal forms a selected fraction of the total composition of the hardfacing material as applied to the drill bit. The granular filler of the rod or tube typically includes various forms of metal carbides (e.g., tungsten, molybdenum, tantalum, niobium, chromium, and vanadium carbides), and more typically, various forms of tungsten carbide. Alternatively, the binder alloy may be in the form of a wire ("a welding wire") and the hardfacing materials are coated on the wire using resin binders. With a PTA welding process, the hardfacing materials may be supplied in the form of a welding tube, a welding wire, or powder, although the powder form is preferred.

In a HVOF spray process, a spray axis of an apparatus for the thermal spray process is preferably aligned perpendicular to a surface of the drill bit. The nozzle of the apparatus then emits detonation waves of hot gases at very high velocities, the detonation waves entraining, for example, a tungsten carbide-based powder therein. A fluid substance such as liquid carbon dioxide may be used to cool the drill bit during the thermal spray process, to prevent the drill bit from being heated above 400° F. The thermal spray process may be repeated a selected number of times, or until a selected thickness is reached In accordance with some embodiments of the invention, different methods of depositing hardfacing may be selected for different layers such that the first hardfacing layer differs from the second hardfacing layer. The different methods may result in different microstructures of the hardfacing layers, leading to different properties. In some embodiments, the first hardfacing layer may differ from the second hardfacing layer such that first hardfacing layer has a hardness less than the second hardfacing layer. In other embodiments, the first hardfacing layer may differ from the second hardfacing layer such that the first hardfacing layer has a carbide content less than the second hardfacing layer.

According to one embodiment of the present invention, the first hardfacing application may use a welding process and the second hardfacing application may use a spray process. In another embodiment, the first hardfacing application may use a spray process and the second hardfacing application may use a welding process. According to another embodiment, the first hardfacing application may use a first welding process and the second hardfacing application may use a second welding process different from the first welding process. In yet another embodiment, the first hardfacing application may use a first spray process and the second hardfacing application may use a second spray process different from the first spray process.

In one embodiment of the present invention, the first hardfacing application uses a type of material different from the type of material used in the second hardfacing application. The materials that may be used include a welding tube, a welding wire, and a tungsten carbide powder.

In accordance with other embodiments of the present invention, the first hardfacing application may use a material having a composition different from the composition of the material used in the second hardfacing application. For example, both the first and second hardfacing may use a welding tube. In such embodiment, the first welding tube has a composition different from the composition of the second welding tube.

While above embodiments make reference to tungsten carbide particles, no limitation is intended on the scope of the invention by such a description. It is specifically within the scope of the present invention that other "hard materials" such as metal oxides, metal nitrides, metal borides, other metal carbides, and alloys thereof may be used.

Additionally, while the above embodiments make reference to discrete hardfacing layers, no limitation is intended on the scope of the invention by such a description. In fact, during hardfacing application, materials at the interface may blend across the interface. Therefore, it is specifically within the scope of the invention that there may be some blending of the multiple hardfacing layers at the interface there between.

Furthermore, in some embodiments, three or more layers of hardfacing may be present. In embodiments having three or more layers of hardfacing, there may be a first hardfacing layer having a first hardness, a second hardfacing layer having a second hardness, and a intermediate hardfacing layer between the first hardfacing layer and the second hardfacing layer, such that the intermediate hardfacing layer has a hardness greater than the first hardness and less than the second hardness.

Advantageously, the present invention provides for a multiple-layered hardfacing, which may provide a greater thickness, and, hence, increased hardness and toughness than a conventional single-layered hardfacing without increased tendency for cracking or delamination in the hardfacing.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A drill bit comprising:

a bit body having at least one blade thereon;

at least one cutter pocket disposed on the at least one blade;

at least one cutter disposed in the at least one cutter pocket; and hardfacing applied to at least a selected portion of the drill bit body, the hardfacing comprising:

a first hardfacing layer disposed on the selected portion of the drill bit body; and a second hardfacing layer disposed on the first hardfacing layer, wherein the first hardfacing layer and the second hardfacing layer differ with respect to at least one property, wherein the thickness of the first hardfacing is greater than the thickness of the second hardfacing layer, and wherein a hardness of the first hardfacing layer is less than a hardness of the second hardfacing layer.

2. The drill bit of claim 1, wherein the at least one property is carbide content, toughness, composition, binder content, density, porosity, elastic modulus, microstructure, abrasion resistance, or erosion resistance.

3. The drill bit of claim 2, wherein the first and second hardfacing layers comprise a transition metal selected from Ni, Co, Fe, and alloys thereof.

4. The drill bit of claim 2, wherein the first hardfacing layer is disposed on at least a portion of the at least one blade.

5. The drill bit of claim 2, wherein the first hardfacing layer has a toughness selected according to a property of a surface of the selected portion of the drill bit.

6. The drill bit of claim 2, wherein the first hardfacing layer and the second hardfacing layer comprise tungsten carbide.

7. The drill bit of claim 6, wherein the first hardfacing layer and the second hardfacing layer comprise spherical cast tungsten carbide.

8. The drill bit of claim 6, wherein the first hardfacing layer and the second hardfacing layer comprise a mixture of crushed cast tungsten carbide and spherical cast tungsten carbide.

9. The drill bit of claim 6, wherein the first hardfacing layer has the carbide content between about 25 and 50% by weight.

10. The drill bit of claim 6, wherein the second hardfacing layer has the carbide content between about 40 and 70% by weight.

11. The drill bit of claim 1, wherein the thickness of the first hardfacing layer is at least twice the thickness of the second hardfacing layer.

12. The drill bit of claim 1, wherein the thickness of the first hardfacing layer is at least three times the thickness of the second hardfacing layer.

13. A drill bit assembly, comprising:

a drill bit, comprising:

a bit body having at least one blade thereon;

a plurality of stabilizer blades; and hardfacing disposed on a selected portion of at least one of the drill bit and the plurality of stabilizer blades, the hardfacing comprising:

a first hardfacing layer disposed on the selected portion of at least one of the bit body and the plurality of stabilizer blades; and a second hardfacing layer coated on the first hardfacing layer, wherein the first hardfacing layer and the second hardfacing layer differ with respect to at least one property, wherein the thickness of the first hardfacing is greater than the thickness of the second hardfacing layer, and wherein a hardness of the first hardfacing layer is less than a hardness of the second hardfacing layer.

14. The hardfacing of claim 13, wherein the at least one property is, carbide content, toughness, composition, binder content, density, porosity, elastic modulus, microstructure, abrasion resistance, or erosion resistance.

15. The hardfacing of claim 13, wherein the hardfacing is located on a selected portion of at least one of the plurality of stabilizer blades.

16. The hardfacing of claim 13, wherein the drill bit assembly comprises a steel body drill bit.

17. A bi-center bit, comprising:

a pilot bit section having an axis therethrough;

a reaming section longitudinally offset from the pilot bit section; and hardfacing disposed on a selected portion of at least one of the pilot bit section and the reaming section, the hardfacing comprising:

a first hardfacing layer disposed on the selected portion of the bi-center bit; and a second hardfacing layer disposed next to the first hardfacing layer, wherein the first hardfacing layer and the second hardfacing layer differ with respect to at least one property, wherein the thickness of the first hardfacing is greater than the thickness of the second hardfacing layer, and wherein a hardness of the first hardfacing layer is less than a hardness of the second hardfacing layer.

* * * * *